US012467477B2

(12) United States Patent
Lee et al.

(10) Patent No.: US 12,467,477 B2
(45) Date of Patent: Nov. 11, 2025

(54) VALVE-INTEGRATED ELECTRIC WATER PUMP

(71) Applicant: COAVIS, Sejong-si (KR)

(72) Inventors: Hyun Tae Lee, Sejong-si (KR); Woo Keun Lee, Sejong-si (KR)

(73) Assignee: COAVIS, Sejong-si (KR)

( * ) Notice: Subject to any disclaimer, the term of this patent is extended or adjusted under 35 U.S.C. 154(b) by 63 days.

(21) Appl. No.: 18/545,934

(22) Filed: Dec. 19, 2023

(65) Prior Publication Data

US 2024/0200573 A1 Jun. 20, 2024

(30) Foreign Application Priority Data

Dec. 20, 2022 (KR) ..... 10-2022-0179130

(51) Int. Cl.

| | |
|---|---|
| ***F04D 29/58*** | (2006.01) |
| ***F04D 1/04*** | (2006.01) |
| ***F04D 13/06*** | (2006.01) |
| ***F04D 29/046*** | (2006.01) |
| ***F04D 29/22*** | (2006.01) |
| ***F04D 29/42*** | (2006.01) |

(52) U.S. Cl.

CPC ..... *F04D 29/588* (2013.01); *F04D 1/04* (2013.01); *F04D 29/5806* (2013.01); *F04D 13/06* (2013.01); *F04D 29/0467* (2013.01); *F04D 29/22* (2013.01); *F04D 29/42* (2013.01)

(58) Field of Classification Search

CPC ..... F04D 29/588; F04D 1/04; F04D 29/5806; F04D 13/06; F04D 29/046; F04D 29/0467; F04D 29/22; F04D 29/42

See application file for complete search history.

(56) References Cited

U.S. PATENT DOCUMENTS

| | | | | |
|---|---|---|---|---|
| 3,667,870 | A * | 6/1972 | Yoshida et al. | F04D 13/0646 417/357 |
| 6,499,442 | B2 * | 12/2002 | Hollis | F01P 5/10 123/41.1 |
| 2009/0223657 | A1 * | 9/2009 | Hollis | F16K 11/085 251/304 |
| 2016/0061092 | A1 * | 3/2016 | Sprygada | F04D 15/0022 123/41.08 |

FOREIGN PATENT DOCUMENTS

| | | | |
|---|---|---|---|
| KR | 20130024096 | A | 3/2013 |
| KR | 20190056029 | A | 5/2019 |
| KR | 102109973 | B1 | 5/2020 |
| KR | 102125868 | B1 | 6/2020 |
| KR | 102250158 | B1 | 5/2021 |
| KR | 20220070623 | A | 5/2022 |

OTHER PUBLICATIONS

Korean Intellectual Property Office, Notice of Allowance Issued in Application No. 10-2022-0179130, Feb. 28, 2025, 9 pages. (Submitted with Partial Translation).

* cited by examiner

*Primary Examiner* — David N Brandt

(74) *Attorney, Agent, or Firm* — McCoy Russell LLP

(57) ABSTRACT

Provided is a valve-integrated electrical water pump in which an impeller for circulating a coolant to the outside and a valve for selectively opening and closing a plurality of ports inside an integrated housing to control a circulation of a coolant used in electric vehicles, thereby simplifying the overall structure of the pump and simplifying an internal flow path.

6 Claims, 5 Drawing Sheets

VALVE-INTEGRATED ELECTRIC WATER PUMP

CROSS-REFERENCE TO RELATED APPLICATIONS

This application claims priority under 35 U.S.C. § 119 to Korean Patent Application No. 10-2022-0179130, filed on Dec. 20, 2022, in the Korean Intellectual Property Office, the disclosure of which is incorporated herein by reference in its entirety.

TECHNICAL FIELD

The following disclosure relates to a new concept technology in which a valve that selectively opens and closes a flow path is integrated and installed inside an integrated housing of a water pump that controls circulation of a coolant used in electric vehicles.

BACKGROUND

Electric vehicles obtain driving energy thereof from electrical energy, rather than from the combustion of fossil fuels like conventional vehicles. However, electric vehicles, which are advantageously free of exhaust gases and incur very little noise, have not been put into practical use due to problems, such as a heavy weight of a battery and time taken for charging. Recently, as problems, such as worsening pollution problems and the depletion of fossil fuels, have been raised, the development of electric vehicles has been accelerated again.

Electric vehicles use a vehicle's cooling system to cool heat generated by a motor or battery and a vehicle's air-conditioning system to control the temperature inside the vehicles.

A water pump and valve assembly that control fluid circulation and flow rate are installed in a vehicle's fluid circulation system, such as the vehicle's cooling system and air-conditioning system.

The water pump is assembled with a body having inlet and outlet ports, a BLDC motor for driving an impeller, and a PCB for control to intake and discharge a required flow rate.

In addition, the valve assembly includes a valve housing to which a plurality of ports are coupled, a valve that rotates inside the valve housing to selectively open and close a plurality of ports, and an actuator that rotates the valve.

Also, the valve assembly is connected to a separately provided water pump to circulate the fluid.

Since the conventional valve assembly and water pump are installed separately, an installation area may increase and a hose connecting the valve assembly to the water pump is required, which complicates a manufacturing process and increases manufacturing costs.

As the related art to solve these problems, "Korean Patent No. 2250158, entitled "Water pump-valve integrated assembly for vehicle thermal management system" is disclosed.

The related art has the feature of improving control of fluid flow by combining a water pump with a valve assembly.

SUMMARY

The related art combines the water pump and the valve assembly with separate fastening members, which not only increases the size and weight of an overall module due to the multiple fastening members, but also increases manufacturing costs due to the additional fastening members and assembly processes, and in addition, it is necessary to apply a sealing structure to secure airtightness of a connection portion between the water pump and the valve assembly and ensure durability, and a differential pressure occurs in a pipeline and efficiency is lowered due to complexity of a shape of a flow path of the connection portion.

The present disclosure is directed to providing a technology of integrally installing an impeller for circulating a coolant to the outside and a valve selectively opening and closing a plurality of ports inside an integrated housing, thereby simplifying an overall structure of a pump and simplifying an internal flow path.

In addition, the present disclosure is directed to providing a technology of directly cooling a motor, while a coolant is introduced into an impeller through the inside of a rotor, by integrally connecting an outlet flow path formed at an upper end of a valve and an intake flow path inside a rotor connected to a discharge flow path of the impeller.

In addition, the present disclosure is directed to providing a technology of allowing the motor and the impeller to be repeatedly cooled, while a portion of coolant circulates inside the integrated housing.

Other features and aspects will be apparent from the following detailed description, the drawings, and the claims.

DETAILED DESCRIPTION OF EXEMPLARY EMBODIMENTS

An exemplary embodiment will be described to implement in more detail the solution to the problem to be solved by the present disclosure.

When briefly referring to an overall configuration according to an exemplary embodiment of the present disclosure based on the accompanying drawings, the overall configuration is largely divided into components of an integrated housing 10, a valve 20, and an impeller 40.

Hereinafter, the present disclosure including the above components will be described in more detail for ease of implementation.

First of all, the present disclosure simplifies an overall structure of a water pump by installing the valve 20 and the impeller 40 in one integrated housing 10.

Figure 1:
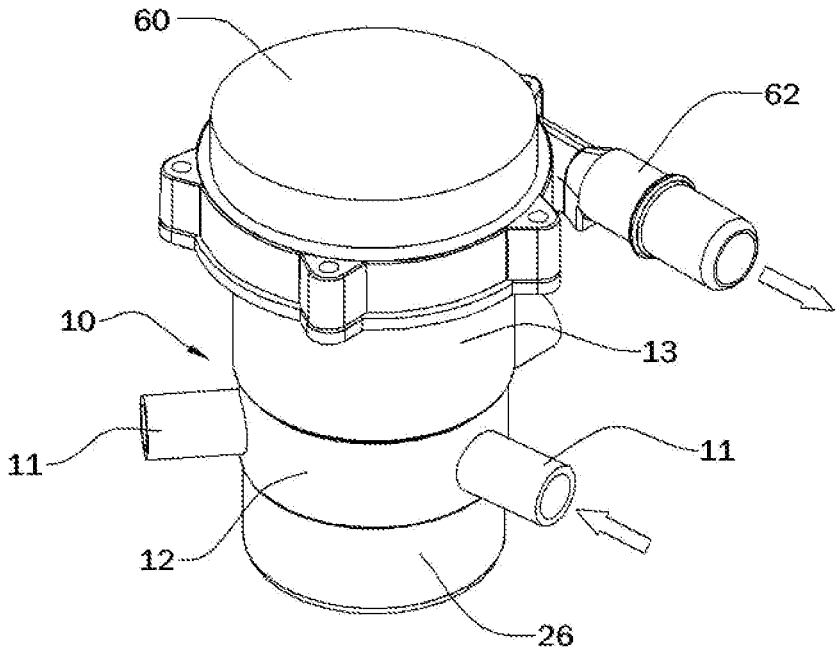
FIG. 1 is a perspective view of an electric water pump to which the present disclosure is applied.
Figure 2:
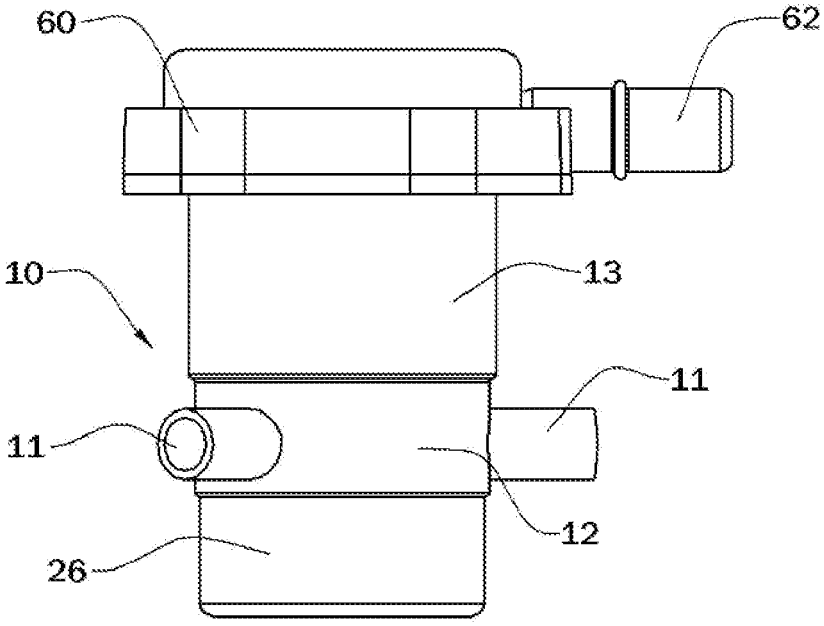
FIG. 2 is a front view of an electric water pump of the present disclosure.
Figure 3:
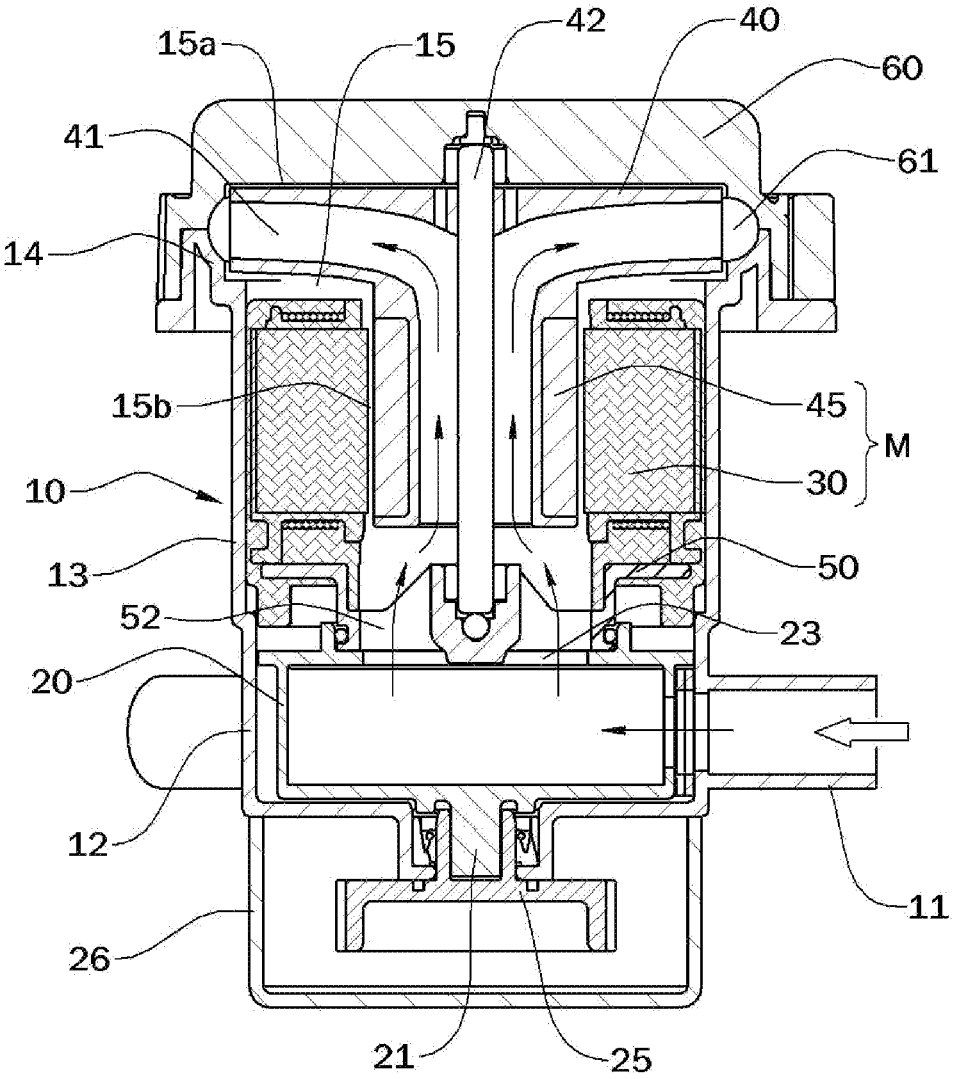
FIG. 3 is a front cross-sectional view of an electric water pump of the present disclosure.
Figure 4:
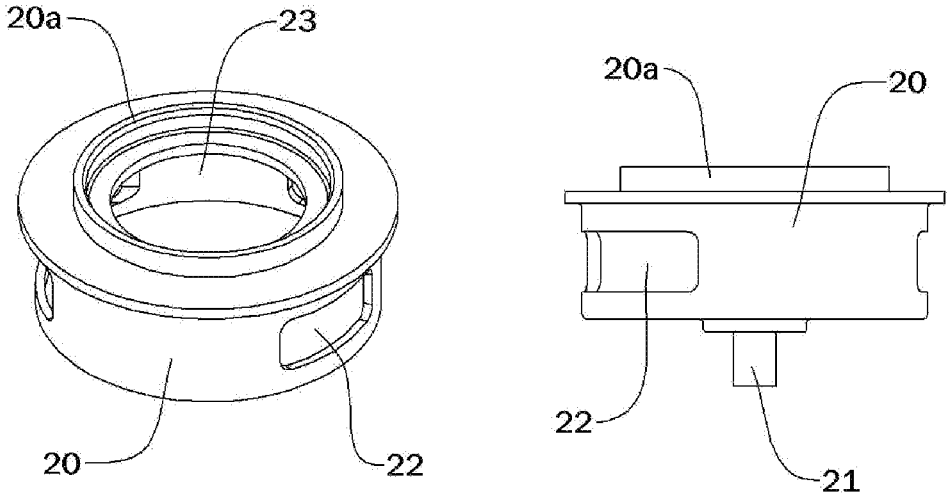
FIG. 4 is a perspective view and a front view of a valve of the present disclosure.

To this end, the valve 20 is installed on an inner lower side of the integrated housing 10 as shown in FIG. 3, and as a rotating shaft 21 protruding from a lower end is integrally coupled with an actuator 25 installed outside the integrated housing 10, the valve 20 serves to selectively open and close a plurality of in-ports 11 formed on an outer circumferential surface of the integrated housing 10, while rotating according to an operation of the actuator 25. A protective cover 26 is installed on a lower surface of the integrated housing 10 to cover the actuator 25, thereby safely protecting the actuator 25, as well as preventing external exposure.

Here, the valve 20 is selectively connected to one of the in-ports 11 and includes a plurality of inlets 22 formed in the circumferential direction to allow a coolant to flow therethrough, and an outlet flow path 23 is formed in the center of an upper end and integrally connected to an intake flow path 46 of a rotor 45 constituting a motor M, while upwardly discharging the coolant by changing a direction of the coolant introduced through the in-port 11.

On an upper side of the valve 20, a stator 30 corresponding to a fixed portion constituting an electromagnetic circuit of the motor among the rotor 45 and the stator 30 constituting the motor M is fixedly installed, and the stator 30 is over-molded to secure durability and waterproofness.

The impeller 40 is rotatably installed on the upper side of the stator 30, and a rotor 45, which plays a rotating portion in the electromagnetic circuit, is integrally formed to protrude from a lower end of the impeller 40. The rotor 45 is disposed to penetrate through the stator 30 to be rotated by the stator 30, and in particular, in the impeller 40, a discharge flow path 41 is integrally connected to the intake flow path formed in a penetrating manner vertically in the center of the rotor 45.

In addition, the outlet flow path 23 formed at an upper end of the valve 20 and the intake flow path 46 of the rotor 45 are integrally connected to allow a coolant to be introduced, so that, when the impeller 40 rotates, the coolant introduced through the in-port 11 passes through the intake flow path 46 inside the rotor 45 through the valve 20 and is smoothly discharged through the discharge flow path 41, and the coolant provides an effect of directly cooling the motor M, while passing through the inside of the rotor 45.

Figure 5:
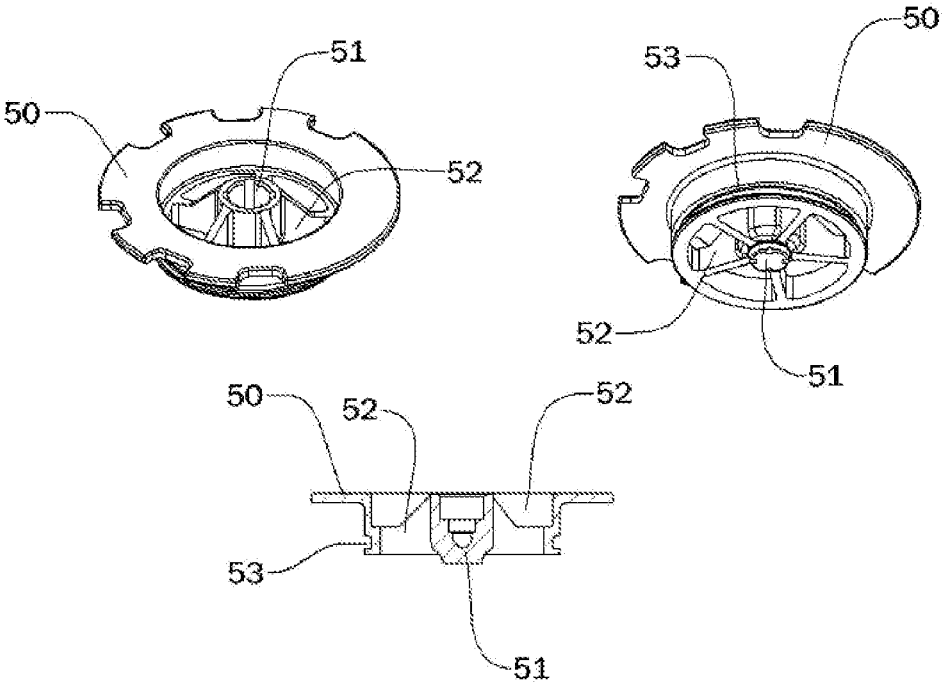
FIG. 5 is a perspective view and front cross-sectional view of the axial support of the present disclosure.

Referring to a rotation support structure of the impeller 40 rotatably installed on the upper side of the stator 30, an axial support 50 is integrally coupled to a lower end of the stator 30, and in the axial support 50, as shown in FIGS. 3 and 5, an axial boss 51 is formed in the center and an inlet flow path 52 of the valve is formed based on the axial boss 51, and the axial support 50 is connected to the outlet flow path 23 fitted to the upper end of the valve 20.

Here, when the axial support 50 and the valve 20 are integrated with each other, a sealing structure to prevent water leakage is incorporated. As a specific solution, as shown in FIG. 8, a lower portion of the axial support 50 is fitted into an engaging protrusion 20*a* formed at the upper end of the valve 20, and an O-ring 54 for sealing is fitted into a ring groove 53 formed on an outer circumferential surface of the portion fitted into the engaging protrusion 20*a*, so that the connection and joining portions of the axial support 50 and the valve 20 provide the effect of preventing water leakage, while maintaining reliable sealing.

Also, an impeller shaft 42 penetrates through the impeller 40 and the rotor 45 and is integrally coupled with the impeller 40, and upper and lower portions of the impeller shaft 42 are rotatably supported by a housing cover 60 and the axial boss 51, so that the impeller 40 may rotate stably.

Figure 7:
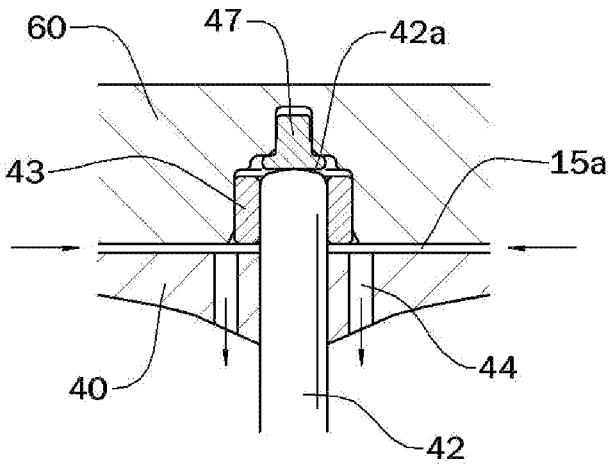
FIG. 7 is an enlarged cross-sectional view of an upper support state of an impeller shaft of the present disclosure.
Figure 8:
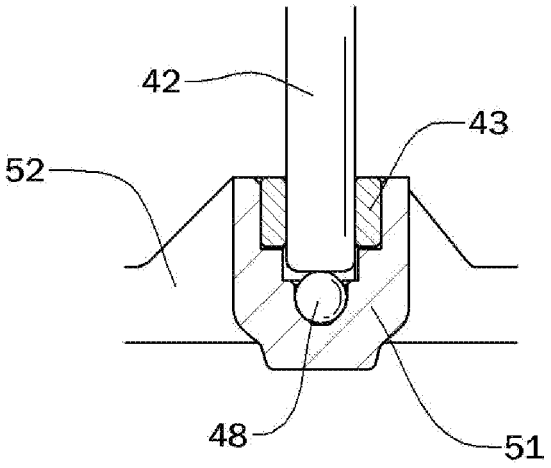
FIG. 8 is an enlarged cross-sectional view of a lower support state of an impeller shaft of the present disclosure.
Figure 9:
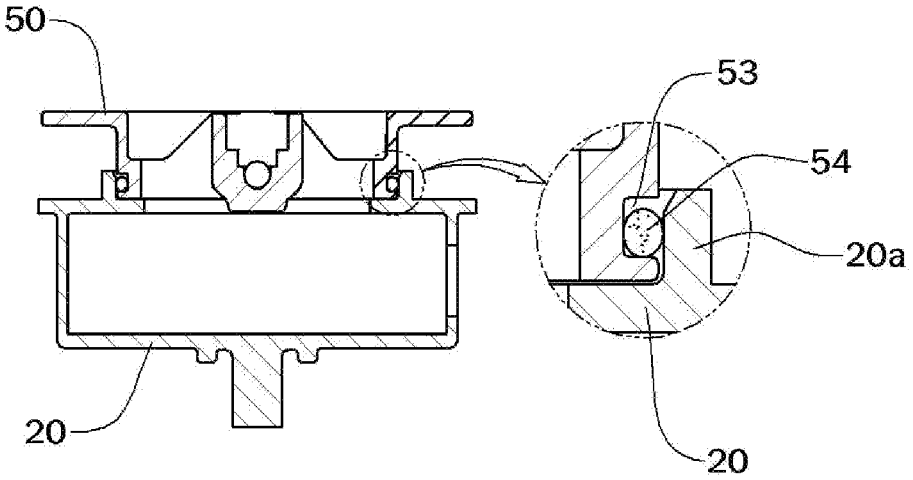
FIG. 9 is a front cross-sectional view of a sealing structure of a joint portion of a valve and an axial support of the present disclosure.

Here, as shown in FIGS. 7 and 8, bushings 43 for preventing frictional resistance are fitted into both upper and lower sides of the impeller shaft 42 to improve smoothness of rotation, and upper and lower ends of the impeller shaft 42 are respectively supported by a thrust pin 47 inserted into and installed in the housing cover 60 or a ball 48 inserted into and installed in the axial boss 51, thereby preventing an axial vertical movement of the impeller shaft 42. In particular, a curved surface 42*a* is formed at an upper end of the impeller shaft 42 and is in point contact with the thrust pin 47 to exert a more smooth rotational force.

In the present disclosure, since the impeller 40 and the valve 20 that perform a pumping function, while rotating according to the operation of the motor M, are built inside the integrated housing 10, and an outlet flow path of the valve 20 and the intake flow path 46 of the rotor 45 form an integrally connected flow path and perform the function of the pump smoothly, an additional connection member for connecting the pump and the valve and a sealing structure of the connection portion as in the related art may be omitted, thereby simplifying the overall structure of the water pump, reducing the weight, simplifying the assembly process, and considerably reducing the manufacturing costs, and providing an effect of improving a difference pressure of the pipeline through simplification of the internal flow path and pumping efficiency.

In addition, the coolant flowing into the valve 20 rotates to form a complex flow, and such a complex flow is stabilized as it passes upwardly through the intake flow path 46 inside the rotor 45 through the outlet flow path 23.

Meanwhile, a specific limited component of the integrated housing 10 of the present disclosure, which allows the valve 20 and the impeller 40 to be integrally installed in one integrated housing 10, will be described.

In the integrated housing 10 for this purpose, as shown in FIG. 3, a valve accommodating portion 12 exclusively accommodating the valve 20 is formed on a lower side, a motor accommodating portion 13 accommodating the stator 30 and the rotor 45 is formed on an upper side of the valve accommodating portion 12, and an impeller accommodating portion 14 accommodating the impeller 40 is formed on an upper side of the motor accommodating portion 13.

Here, since the valve accommodating portion 12, motor accommodating portion 13, and impeller accommodating portion 14, which are distinguished from each other, are formed to have a stepped structure in which a cross-sectional area increases upwardly so that the valve 20, the stator 30, and the impeller 40 may be easily integrally installed downwardly in this order, the valve 20, the stator 30, and the impeller 40 may be easily installed, and since the valve 20, the stator 30, and the impeller 40 are integrally installed inside the single integrated housing 10, an overall structure of the water pump may be simplified.

In addition, the housing cover 60 is coupled to and installed on an upper end of the integrated housing 10 to seal the integrated housing 10 and exert a function of rotatably supporting the upper side of the impeller shaft 42. A discharge guide path 61 is formed in the circumferential direction on the inner circumferential surface of the cover 60. The discharge guide path 61 is connected to an out-port 62 protruding to the outside, so that a coolant discharged from the discharge flow path 41 of the impeller 40 may be smoothly discharged to the outside through the out-port 62 by way of the discharge guide path 61.

In addition, the present disclosure additionally incorporates a new technology that allows the motor M and the impeller 40 to be repeatedly cooled while a portion of the coolant circulates inside the integrated housing 10.

As a technical configuration therefor, a gap 15 is formed between the impeller 40 and the stator 30, a gap 15*a* is formed between an upper end of the impeller 40 and the housing cover 60, and a gap 15*b* is also formed between the rotor 45 and the stator 30.

Therefore, a portion of the coolant discharged through the impeller 40 provides an effect of cooling the motor M and the impeller 40, while smoothly circulating the gap 15 formed between the impeller 40 and the stator 30, the gap 15*a* formed between the upper end of the impeller 40 and the housing cover 60, the gap 15*b* formed between the rotor 45 and the stator 30, and a lower side of the intake flow path 46.

Figure 6:
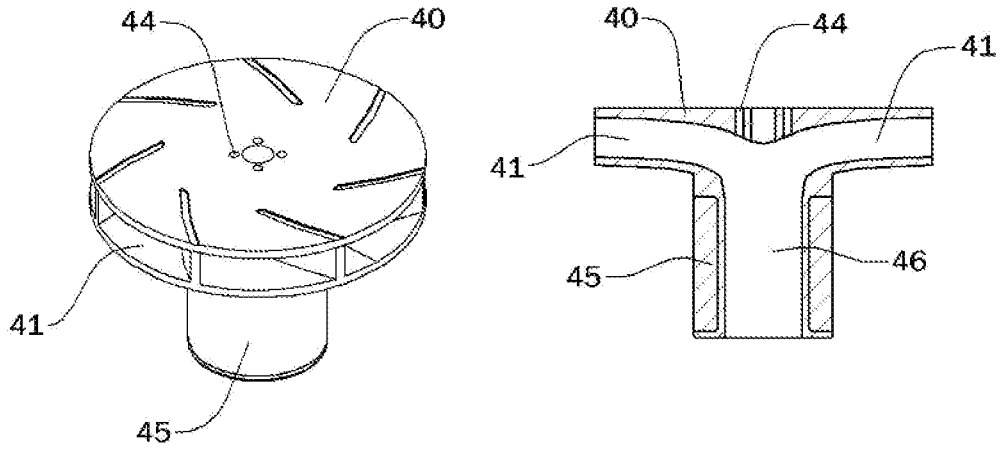
FIG. 6 is a perspective view and a front cross-sectional view of an impeller and a rotor of the present disclosure.

Here, a plurality of cooling flow paths 44 communicating with the discharge flow path 41 are formed at the upper end of the impeller 40 as shown in FIGS. 6 and 7, and the coolant introduced into the gap 15*a* formed between the upper end of the impeller 40 and the housing cover 60 may further cool the impeller 40, while passing through the cooling flow path 44.

According to the present disclosure, the impeller and the valve are built together inside the integrated housing, and a simplified flow path in which the outlet flow path of the valve and the intake flow path of the rotor are integrally connected is formed, and thus, an additional connection member for connecting the water pump and the valve and a sealing structure of the connection portion as in the related art may be omitted, thereby providing effects of simplifying the overall structure of the water pump, reducing the weight, simplifying the assembly process, significantly reducing manufacturing costs, and improving a differential pressure in pipeline and pumping efficiency through simplification of the internal flow path.

In addition, the present disclosure provides the effect of directly cooling the motor while the coolant passes through the inside of the rotor by integrally connecting the outlet flow path of the valve and the intake flow path inside the rotor connected to the discharge flow path of the impeller, and since a complex flow introduced from the valve is stabilized, while upwardly passing through the intake flow path inside the rotor, an effect of removing cavitation and noise is provided.

In addition, the present disclosure provides the effect of preventing overheating and improving durability while repeatedly cooling the motor and impeller by circulating a portion of the coolant through the gaps formed between the impeller, stator, and rotor installed inside the integrated housing.

DETAILED DESCRIPTION OF MAIN ELEMENTS

| | |
|---|---|
| M: motor | 10: integrated housing |
| 11: in-port | 12: valve accommodating portion |
| 13: motor accommodating portion | 14: impeller accommodating part |
| 15, 15a, 15b: gap | 20: valve |
| 20a: engaging protrusion | 21: rotating shaft |
| 22: Inlet | 23: outlet flow path |
| 25: actuator | 30: stator |
| 40: impeller | 41: discharge flow path |
| 42: impeller shaft | 42a: curved surface |
| 43: bushing | 44: cooling flow path |
| 45: rotor | 46: intake flow path |
| 48: ball | 50: axial support |
| 51: axial boss | 52: inlet flow path |

-continued

| | |
|---|---|
| 54: O-ring | 60: housing cover |
| 61: discharge flow path | 62: out-port |

What is claimed is:

1. A valve-integrated electric water pump comprising:

a valve installed on an inner lower side of an integrated housing and rotating according to an operation of an actuator to selectively open and close a plurality of in-ports;

a stator positioned on an upper side of the valve;

an axial support coupled to a lower end of the stator and fitted into an upper end of the valve;

an impeller rotatably installed on an upper side of the stator and having a plurality of discharge flow paths extending radially outward from a center of the impeller; and a rotor protruding from a lower end of the impeller and disposed to penetrate through the stator and having an intake flow path formed vertically through a center of the rotor;

wherein the plurality of discharge flow paths of the impeller are integrally connected to the intake flow path of the rotor, wherein an outlet flow path formed at an upper end of the valve and the intake flow path are connected to allow coolant to flow therethrough, and wherein the axial support includes an axial boss and a plurality of inlet flow paths formed around the axial boss, the plurality of inlet flow paths connected to the outlet flow path of the valve and the intake flow path, and an impeller shaft is integrally coupled with the impeller and the rotor, and an upper end of the impeller shaft is rotatably coupled to a housing cover coupled to and installed on an upper end of the integrated housing, and a lower end of the impeller shaft is rotatably coupled to the axial boss.

2. The valve-integrated electric water pump of claim 1, wherein the integrated housing is comprised of a valve accommodating portion accommodating the valve on a lower side of the integrated housing, a motor accommodating portion accommodating the stator and the rotor are formed on an upper side of the valve accommodating portion, and an impeller accommodating portion accommodating the impeller is formed on an upper side of the motor accommodating portion.

3. The valve-integrated electric water pump of claim 1, wherein a discharge guide flow path formed on an inner circumferential surface of the housing cover is connected to an out-port protruding to an outside so that coolant discharged from the plurality of discharge flow paths of the impeller is discharged to the outside through the out-port by way of the discharge guide flow path.

4. The valve-integrated electric water pump of claim 1, wherein bushings are fitted to both of the upper and lower ends of the impeller shaft, and the upper and lower ends of the impeller shaft are respectively supported by a thrust pin or a ball inserted into the housing cover and the axial boss, respectively.

5. The valve-integrated electric water pump of claim 1, wherein a lower portion of the axial support is fitted into an engaging protrusion formed at the upper end of the valve, and an O-ring for sealing is fitted into an outer circumferential surface of the lower portion fitted into the engaging protrusion.

6. The valve-integrated electric water pump of claim 1, wherein a portion of the coolant is discharged through the impeller and repeatedly cools the impeller and a motor, the motor comprised of the stator and the rotor, while the portion of the coolant is circulating through:

a first gap formed between an upper end of the impeller and the housing cover, a second gap formed between the rotor and the stator, and a lower side of the intake flow path.

* * * * *